US008419486B2

(12) United States Patent
Tyler

(10) Patent No.: US 8,419,486 B2
(45) Date of Patent: Apr. 16, 2013

(54) RECEPTACLE TERMINAL WITH A CONTACT SPRING

(75) Inventor: Adam Price Tyler, Rochester Hills, MI (US)

(73) Assignee: Tyco Electronics Corporation, Berwyn, PA (US)

( * ) Notice: Subject to any disclaimer, the term of this patent is extended or adjusted under 35 U.S.C. 154(b) by 201 days.

(21) Appl. No.: 12/971,256

(22) Filed: Dec. 17, 2010

(65) Prior Publication Data

US 2012/0156947 A1 Jun. 21, 2012

(51) Int. Cl.
*H01R 13/11* (2006.01)

(52) U.S. Cl.
USPC ..... 439/842; 439/845

(58) Field of Classification Search ..... 439/842, 439/843, 845, 851
See application file for complete search history.

(56) References Cited

U.S. PATENT DOCUMENTS

| | | | | |
|---|---|---|---|---|
| 4,878,862 | A | 11/1989 | Wise | |
| 4,981,449 | A | 1/1991 | Buchter | |
| 4,983,132 | A | 1/1991 | Weidler | |
| 4,995,814 | A | 2/1991 | Weidler | |
| 5,013,265 | A | 5/1991 | Buchter et al. | |
| 5,588,884 | A * | 12/1996 | Rudoy et al. | 439/845 |
| 6,276,960 | B1 * | 8/2001 | Schaefer et al. | 439/522 |
| 6,287,156 | B1 * | 9/2001 | Swan et al. | 439/845 |
| 6,416,340 | B2 * | 7/2002 | Schaefer et al. | 439/224 |
| 6,485,337 | B2 * | 11/2002 | Hsieh | 439/845 |
| 6,692,316 | B2 * | 2/2004 | Hsieh et al. | 439/845 |
| 7,150,660 | B2 * | 12/2006 | Allgood et al. | 439/845 |
| 7,204,471 | B2 | 4/2007 | Pietrobon | |
| 7,499,262 | B1 | 3/2009 | Darr | |
| 7,601,019 | B2 * | 10/2009 | Hsieh et al. | 439/345 |
| 7,766,706 | B2 * | 8/2010 | Kawamura et al. | 439/839 |
| 2003/0194919 | A1 | 10/2003 | Hsieh et al. | |
| 2004/0040733 | A1 | 3/2004 | Yuasa et al. | |
| 2007/0066152 | A1 * | 3/2007 | Mohs et al. | 439/843 |

FOREIGN PATENT DOCUMENTS

| | | | |
|---|---|---|---|
| DE | 10244946 | A1 | 4/2003 |
| DE | 10200503696 | A1 | 3/2006 |
| DE | 102005017988 | B3 | 11/2006 |

OTHER PUBLICATIONS

International Search Report, International Application No. PCT/US2011//001987, International Filing Date, Dec. 16, 2011.

* cited by examiner

*Primary Examiner* — Hae Moon Hyeon

(57) ABSTRACT

A receptacle terminal includes a terminal body with a cable end configured to be terminated to a cable and a mating end configured to be mated with a blade terminal. The terminal body includes a receptacle at the mating end. The receptacle has a first wall and a second wall generally parallel to, and spaced apart from, the first wall. The receptacle has a receiving space between the first and second walls configured to receive the blade terminal. A contact spring is separately provided from, and coupled to, the terminal body and has a spring wall received in the receiving space that is positioned between the first wall and the blade terminal. The spring wall has an inner surface and an outer surface. The inner surface is spring biased against the first wall. The outer surface is configured to be spring biased against the blade terminal.

20 Claims, 5 Drawing Sheets

RECEPTACLE TERMINAL WITH A CONTACT SPRING

BACKGROUND OF THE INVENTION

The subject matter herein relates generally to electrical systems, and more particularly, to receptacle terminals.

Power systems are known for making electrical connections between various components of the power system. Typically, power terminals are terminated to an end of a cable and configured for mating with a corresponding power terminal. An example of such a power system is in electric vehicles, where electric power is transferred between power connectors.

Some power connectors use a power terminal that is received on a bolt and connected thereto using a nut, such as a wing nut. Such power connectors are not without disadvantages. For example, such power connectors utilize multiple components, and are time consuming and may be difficult to mate and unmate. Additionally, such power connectors may not provide an adequate connection for high power situations. Other types of power connectors have one connector with a terminal having a receptacle and the other connector having a blade that plugs into the receptacle. Such power connectors are not without disadvantages. For example, it may be difficult to maintain the interface between the receptacle and the blade. The design of the receptacle may be complex to ensure electrical connection is maintained with the blade, making the overall design more expensive to manufacture. Connections other than power connections may use terminals with receptacles that receive blades to make electrical connection therebetween. Such connections suffer from the same disadvantages.

A need remains for a receptacle terminal that is reliable and cost effective. A need remains for a connector having receptacle terminals that are reliable and cost effective.

BRIEF DESCRIPTION OF THE INVENTION

In one embodiment, a receptacle terminal is provided having a terminal body with a cable end configured to be terminated to a cable and a mating end configured to be mated with a blade terminal. The terminal body includes a receptacle at the mating end. The receptacle has a first wall and a second wall generally parallel to, and spaced apart from, the first wall. The receptacle has a receiving space between the first and second walls configured to receive the blade terminal. A contact spring is separately provided from, and coupled to, the terminal body and has a spring wall received in the receiving space that is positioned between the first wall and the blade terminal. The spring wall has an inner surface and an outer surface. The inner surface is spring biased against the first wall. The outer surface is configured to be spring biased against the blade terminal.

In a further embodiment, a contact spring is provided for a receptacle terminal having first and second walls with a receiving space therebetween that receives a blade terminal. The contact spring includes an end wall having opposite edges, first and second side walls and first and second spring walls. The first and second side walls extend from corresponding edges of the end wall. The first side wall is configured to extend along the first wall of the receptacle terminal. The second side wall is configured to extend along the second wall of the receptacle terminal. The first and second spring walls extend from the first and second side walls, respectively. The first spring wall is configured to extend along the first wall of the receptacle terminal within the receiving space. The second spring wall is configured to extend along the second wall of the receptacle terminal within the receiving space. The first and second spring walls are configured to engage opposite sides of the blade terminal when received in the receiving space.

In an alternative embodiment, a power connector is provided that has a housing having a mating face and a receptacle terminal held by the housing at the mating face. The receptacle terminal includes a terminal body that has a cable end configured to be terminated to a cable and a mating end configured to be mated with a blade terminal. The terminal body comprises a receptacle at the mating end. The receptacle has a first wall and a second wall generally parallel to, and spaced apart from, the first wall. The receptacle has a receiving space between the first and second walls that receives the blade terminal. A contact spring is separately provided from, and coupled to, the terminal body and has a spring wall received in the receiving space that is configured to be positioned between the first wall and the blade terminal. The spring wall has an inner surface and an outer surface with the inner surface being spring biased against the first wall and the outer surface being spring biased against the blade terminal.

DETAILED DESCRIPTION OF THE INVENTION

Figure 1:
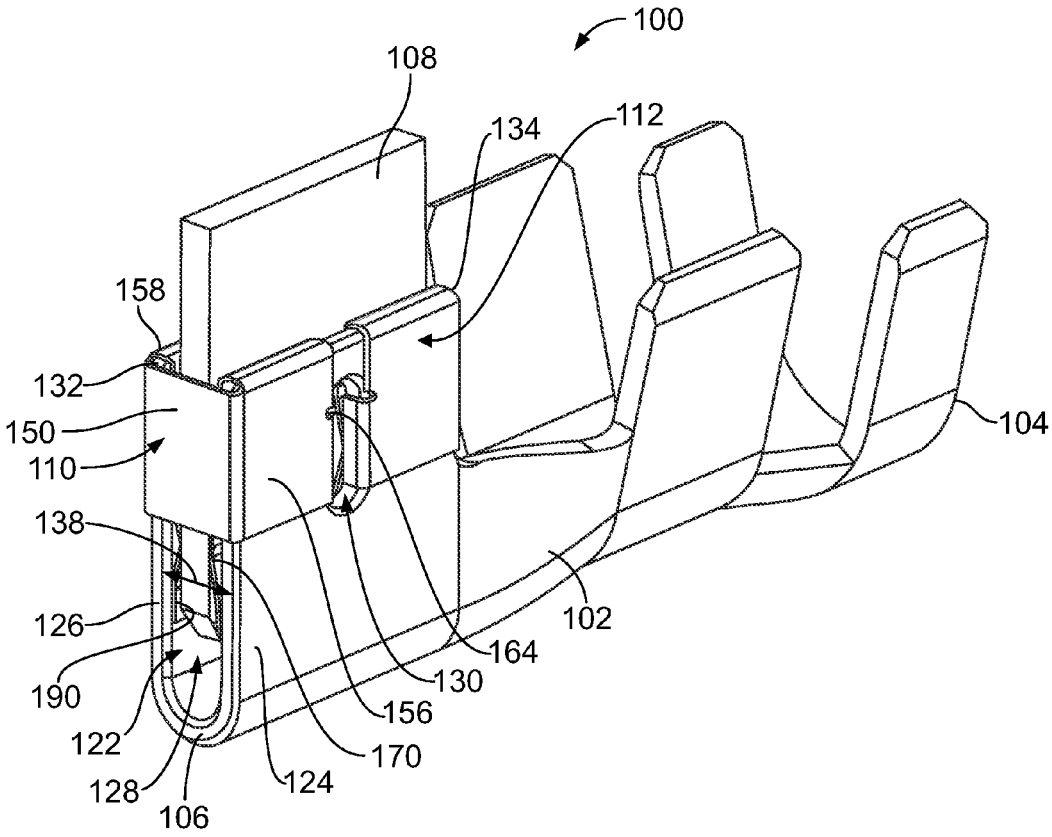
FIG. 1 is a perspective view of a receptacle terminal formed in accordance with an exemplary embodiment showing a mating blade of a blade terminal.

FIG. 1 is a perspective view of a receptacle terminal 100 formed in accordance with an exemplary embodiment. The receptacle terminal 100 includes a terminal body 102 extending between a cable end 104 and a mating end 106. The cable end 104 is configured to be terminated to a cable or wire, such as a power cable (not shown), and the mating end 106 is configured to be mated with a blade of a mating terminal such as a blade terminal 108.

A pair of contact springs 110, 112 are coupled to the mating end 106 of the terminal body 102. The contact springs 110, 112 create an interface between the blade terminal 108 and the receptacle terminal 100. In the illustrated embodiment, two contact springs 110, 112 are separately provided and coupled to the terminal body 102. Alternatively, more or less than two contact springs 110, 112, for example, a single contact spring, may be coupled to the terminal body 102 in an alternative embodiment. The contact springs 110, 112 define a conductive interface between the blade terminal 108 and the terminal body 102.

The contact springs 110, 112 provide multiple points of contact to the receptacle terminal 100 and provide multiple points of contacts to the blade terminal 108. The contact springs 110, 112 provide a spring force against, and are biased against, the receptacle terminal 100 and the blade terminal 108 to ensure that an electrical connection is maintained between the blade terminal 108 and the terminal body 102. The contact springs 110, 112 are held against the terminal body 102 by a mechanical connection between the contact springs 110,112 and the terminal body 102. Additional securing features are not necessary to hold the contact springs 110, 112 on the terminal body 102. The contact springs 110, 112 do not need to be laser-welded, soldered or crimped onto the terminal body 102. The contact springs 110, 112 may be easily mounted to the terminal body 102 without using additional features that may add to the cost of the receptacle terminal 100 or add to the assembly time of the receptacle terminal 100.

Figure 2:
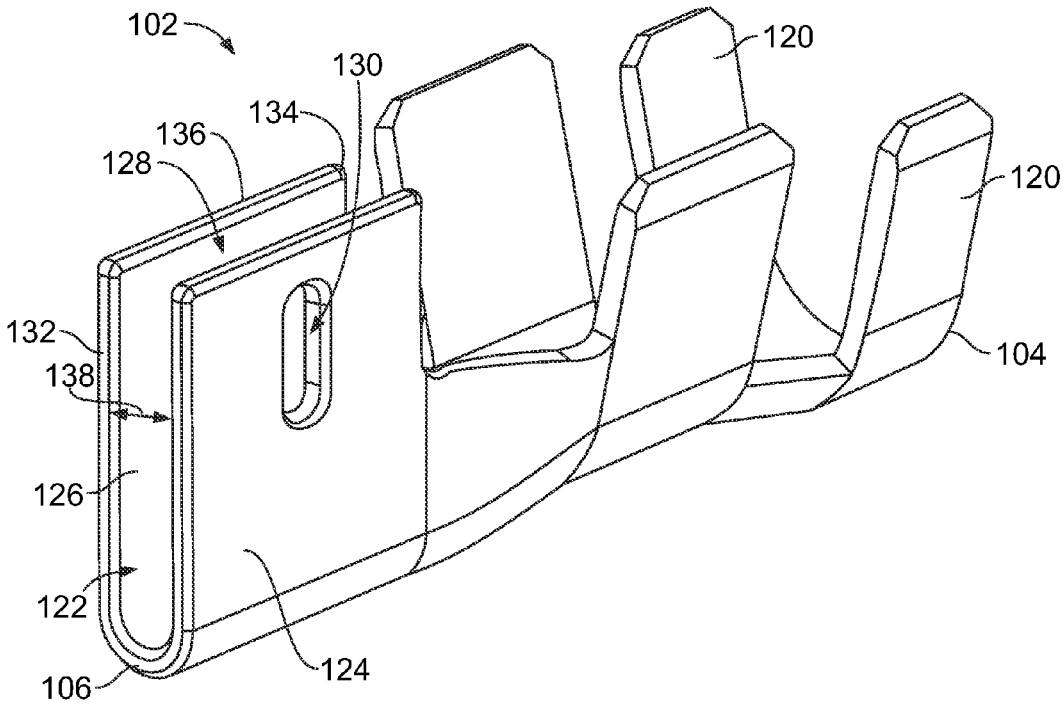
FIG. 2 is a perspective view of the terminal body shown in FIG. 1.

FIG. 2 is a perspective view of the terminal body 102 without the contact springs 110, 112. The terminal body 102 is manufactured from a conductive material, such as a metal material. In an exemplary embodiment, the terminal body 102 is stamped and formed into a shape configured for terminating to a cable and for mating with the blade terminal 108 (shown in FIG. 1).

The cable end 104 is configured to be terminated to a cable. In the illustrated embodiment, the cable end 104 constitutes a crimp connection that is configured to be crimped to the end of the cable. The terminal body 102 includes crimp arms 120 at the cable end 104 that are initially stamped and formed into an open state defining a channel. Any number of crimp arms 120 may be provided. During manufacture, the crimp arms 120 are crimped to the cable during a crimping process. The cable end 104 may be terminated to the cable by an alternative means in an alternative embodiment. For example, the cable end 104 may include a barrel for crimping or may be soldered to the cable.

In the illustrated embodiment, the terminal body 102 is generally U-shaped at the mating end 106 with the first and second walls 124, 126 defining portions of the U-shaped terminal body 102. The mating end 106 includes a receptacle 122 defined by the U-shaped terminal body 102. The receptacle 122 receives the contact springs 110, 112 and the blade terminal 108. The receptacle 122 is defined by a first wall 124 and a second wall 126. The first and second walls 124, 126 are parallel to, and spaced apart from, one another. The receptacle 122 has a receiving space 128 between the first and second wall 124, 126 that receives that blade terminal 108. The receiving space 128 is open through the top and is configured to receive the blade terminal 108 through the open top. Alternatively, the receiving space 128 may be configured to receive the blade terminal 108 from a different direction, such as through a side of the receiving space 128 (e.g., through the first end 132) or through an opening in the bottom (not shown).

In an exemplary embodiment, the first and second walls 124, 126 include openings 130 therethrough (only the opening 130 in the first wall 124 is illustrated in FIG. 2). The openings 130 are spaced apart from opposites ends 132, 134 of the receptacle 122. Optionally, the openings 130 may be substantially centered between the first and second ends 132, 134. Alternatively, the openings 130 may be offset from a centerline between the first and second ends 132, 134. The openings 130 are spaced from a top edge 136 thereof. Optionally, the openings 130 are elongated and have an oval shape. Alternative shapes are possible in alternative embodiments.

The first and second walls 124, 126 are spaced apart from one another by a distance 138. The distance 138 may be generally uniform along the length of the receiving space 128 measured between the first and second ends 132, 134. Additionally, the distance 138 may also be uniform along the height of the receiving space 128 measured from the top edge 136 to the bottom of the U-shaped terminal body 102. The distance 138 is sufficiently wide to accommodate the blade terminal 108 and the contact springs 110, 112.

Figure 3:
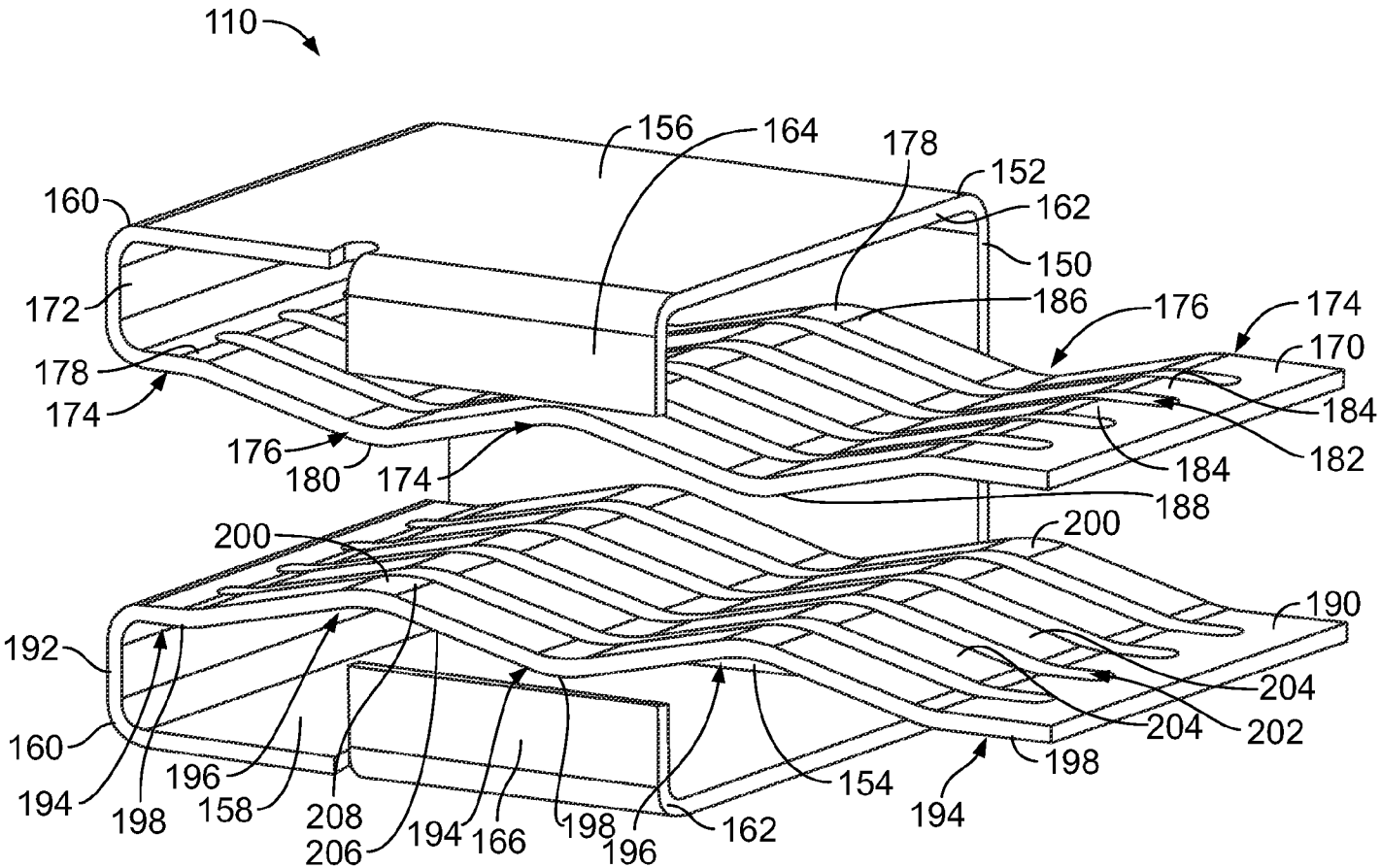
FIG. 3 is a perspective view of the contact spring shown in FIG. 1.

FIG. 3 is a perspective view of the contact spring 110. The contact spring 112 (shown in FIG. 1) may be substantially identical to the contact spring 110, having a single part number and thus reducing the overall cost of the receptacle terminal 100 by having a reduced part count and/or a reduced manufacturing cost. Alternatively, the contact springs 110, 112 may differ from one and may include different features and/or may be sized and shaped differently than one another.

The contact spring 110 includes an end wall 150 having opposite edges 152, 154. The contact spring 110 includes first and second side walls 156, 158 extending from corresponding edges 152, 154 of the end wall 150. Optionally, the side walls 156, 158 may extend generally perpendicular with respect to the end wall 150. Optionally, the side walls 156, 158 may be generally planar and oriented substantially parallel to one another. The end wall 150 and the first and second side walls 156, 158 together define a U-shaped structure. The first and second side walls 156, 158 each have a top 160 and bottom 162. The tops 160 of the side walls 156, 158 may be aligned with one another and may be aligned with a top of the end wall 150. Similarly, the bottoms 162 of the side walls 156, 158 may be aligned with one another and may be aligned with a bottom of the end wall 150.

A first tab 164 extends from the first side wall 156 generally opposite the end wall 150. A second tab 166 extends from the second side wall 158 generally opposite the end wall 150. Optionally, the first and second tabs 164, 166 may be positioned generally at the bottom 162 of the first and second walls 156, 158. The first and second tabs 164, 166 may be oriented generally perpendicular to the first and second walls 156, 158. The first and second tabs 164, 166 are bent inward toward one another. Other orientations are possible in alternative embodiments. The first and second tabs 164, 166 are configured to be received in corresponding openings 130 (shown in FIG. 2) in the first and second walls 124, 126 (shown in FIG. 2) of the terminal body 102 (shown in FIG. 2) when the contact spring 110 is coupled to the terminal body 102. For example, when the contact spring 110 is coupled to the terminal body 102, the first and second side walls 156, 158 wrap around the first and second walls 124, 126 of the terminal body 102 along the outsides of the first and second walls 124, 126. The first and second tabs 164, 166 are aligned with, and received within, the openings in the first and second walls 124, 126, respectively.

The contact spring 110 includes a first spring wall 170. A connecting portion 172 is provided between the first spring wall 170 and the first side wall 156. The connecting portion 172 is oriented generally perpendicular with respect to the first side wall 156. The first spring wall 170 is oriented generally perpendicular with respect to the connecting portion 172. In an exemplary embodiment, the first spring wall 170 is oriented generally parallel to the first side wall 156 and is spaced apart from the first side wall 156. When the contact spring 110 is mounted to the terminal body 102, the first wall 124 is received between the first spring wall 170 and the first side wall 156.

In an exemplary embodiment, the first spring wall 170 is non-planar. The first spring wall 170 defines a wave spring having a wavy configuration to give a spring effect. The first spring wall 170 follows a serpentine path having a series of peaks and valleys. The first spring wall 170 has concave portions 174 and convex portions 176. The concave portions 174 define the valleys and the convex portions 176 define the peaks. The concave portions 174 include apexes 178 defining mating interfaces for engaging first wall 124. The convex portions 176 include apexes 180 defining mating interfaces for engaging the blade terminal 108 (shown in FIG. 1). In an exemplary embodiment, the first spring wall 170 has multiple concave portions 174 and multiple convex portions 176. The first spring wall 170 makes multiple, longitudinally offset points of contact with the first wall 124 and with the blade terminal 108.

The first spring wall 170 includes a plurality of slots 182 extending therethrough. The slots 182 separate the first spring wall 170 into a plurality of individual, parallel spring fingers 184 that are independently moveable with respect to one another. Each of the spring fingers 184 are configured to engage the first wall 124 and each of the spring fingers 184 are configured to engage the blade terminal 108.

The first spring wall 170 includes an inner surface 186 and an outer surface 188 opposite the inner surface 186. The inner surface 186 generally faces and is configured to engage the first wall 124. The outer surface 188 generally faces and is configured to engage the blade terminal 108.

The contact spring 110 includes a second spring wall 190. A connecting portion 192 is provided between the second spring wall 190 and the second side wall 158. The connecting portion 192 is oriented generally perpendicular with respect to the second side wall 158. The second spring wall 190 is oriented generally perpendicular with respect to the connecting portion 192. In an exemplary embodiment, the second spring wall 190 is oriented generally parallel to the second side wall 158 and is spaced apart from the second side wall 158. The second spring wall 190 is also spaced apart from the first spring wall 190. The first and second spring walls 170, 190 are positioned between the first and second side walls 156, 158. The first and second spring walls 170, 190 are internal of the U-shaped body defined by the end wall 150 and the first and second side walls 156, 158. When the contact spring 110 is mounted to the terminal body 102, the second wall 126 is received between the second spring wall 190 and the second side wall 158. The terminal blade 108 is configured to be received between the first and second spring walls 170, 190.

In an exemplary embodiment, the second spring wall 190 is non-planar. The second spring wall 190 defines a wave spring having a wavy configuration to give a spring effect. The second spring wall 190 follows a serpentine path having a series of peaks and valleys. The second spring wall 190 has concave portions 194 and convex portions 196. The concave portions 194 define the valleys and the convex portions 196 define the peaks. The concave portions 194 include apexes 198 defining mating interfaces for engaging the second wall 126. The convex portions 196 include apexes 200 defining mating interfaces for engaging the blade terminal 108 (shown in FIG. 1). In an exemplary embodiment, the second spring wall 190 has multiple concave portions 194 and multiple convex portions 196. The second spring wall 190 makes multiple, longitudinally offset points of contact with the second wall 126 and with the blade terminal 108.

The second spring wall 190 includes a plurality of slots 202 extending therethrough. The slots 202 separate the second spring wall 190 into a plurality of individual, parallel spring fingers 204 that are independently moveable with respect to one another. Each of the spring fingers 204 are configured to engage the second wall 126 and each of the spring fingers 204 are configured to engage the blade terminal 108.

The second spring wall 190 includes an inner surface 206 and an outer surface 208 opposite the inner surface 206. The inner surface 206 generally faces and is configured to engage the second wall 126. The outer surface 208 generally faces and is configured to engage the blade terminal 108.

In an exemplary embodiment, the contact spring 110 is manufactured from a conductive material, such as a metal material. The contact spring 110 may be manufactured from a copper material or a copper alloy. Optionally, the contact spring 110 may be plated with a plating material. The contact spring 110 may be selectively plated, such as on the first spring wall 170 and the second spring wall 190. The contact spring 110 may be plated with a nickel material, a gold material, a tin material and the like.

Returning to FIG. 1, the contact springs 110, 112 are illustrated coupled to the terminal body 102. The contact springs 110, 112 are identical to one another, with the contact spring 112 being inverted 180 degrees with respect to the contact spring 110. During assembly, the contact spring 110 is coupled to the first end 132 of the mating end 106 of the terminal body 102. The contact spring 112 is coupled to the second end 134 of the mating end 106 of the terminal body 102. The assembly will be described with reference to the contact spring 110. The contact spring 112 is coupled to the terminal body 102 in a similar manner as the contact spring 110.

The contact spring 110 is loaded onto the mating end 106 from above. The spring walls 170, 190 are loaded into the receiving space 128 between the first and second walls 124, 126. The end wall 150 and side walls 156, 158 wrap around the first and second walls 124, 126 of the receptacle 122 and are provided along the outside of the first and second walls 124, 126. The end wall 150 spans between the first and second walls 124, 126. The end wall 150 limits deflection of the first and second walls 124, 126 away from one another when the blade terminal 108 is loaded into the receptacle 122. As such, the contact spring 110 holds the relative position of the first wall 124 with respect to the second wall 126. The contact spring 110 maintain the distance 138 between the first and second walls 124, 126.

During assembly, the tabs 164, 166 (shown in FIG. 3) are received in the openings 130. The interaction between the tabs 164, 166 and the openings 130 hold the contact spring 110 on the terminal body 102. For example, the tabs 164, 166 resist sliding the contact spring 110 off of the first end 132 of the walls 124, 126.

Figure 4:
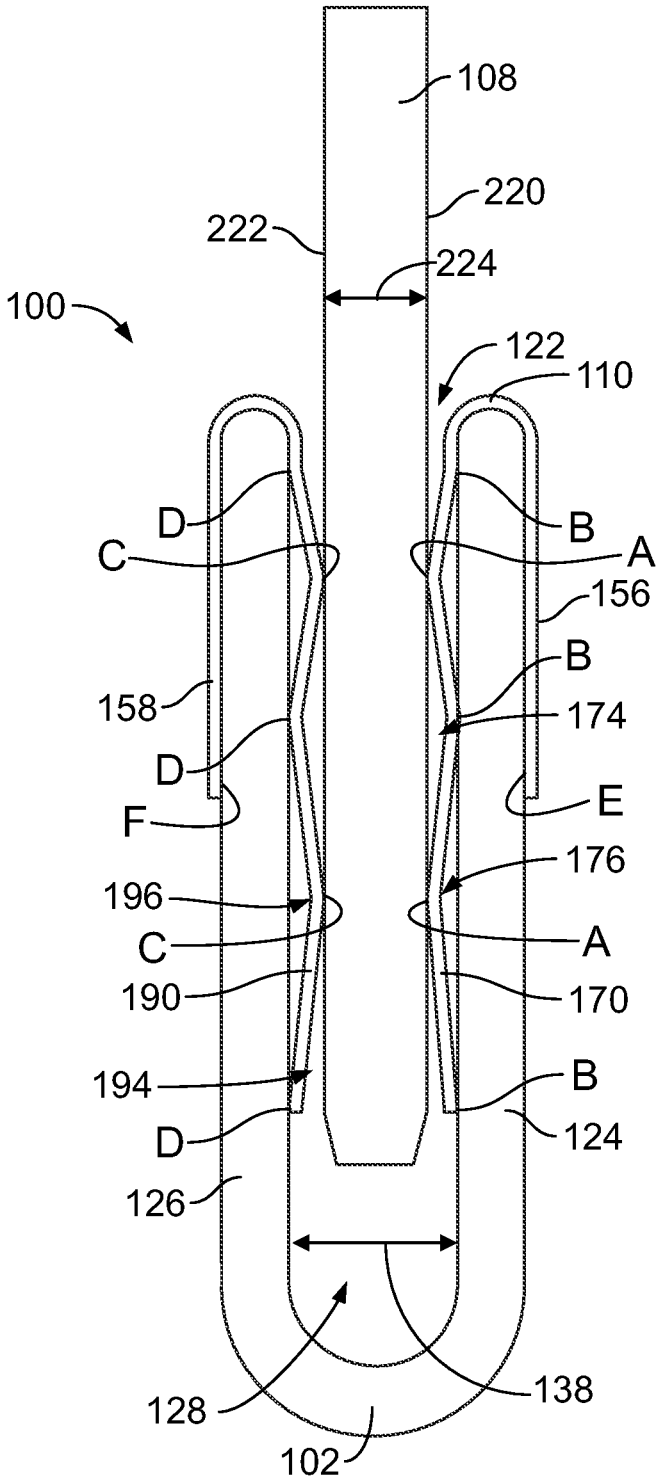
FIG. 4 is a cross sectional view of the receptacle terminal and mating blade shown in FIG. 1.

FIG. 4 is a cross sectional view of the receptacle terminal 100 with the blade terminal 108 received in the receptacle 122. The blade terminal 108 includes opposite planar sides 220, 222. The blade terminal 108 has a thickness 224 measured between the opposite sides 220, 222. The thickness 224 is less than the distance 138 such that the blade terminal 108 may be received in the receiving space 128 between the first and second walls 124, 126.

The contact spring 110 is coupled to the terminal body 102 such that the first and second spring walls 170, 190 are loaded into the receiving space 128. The first spring wall 170 is configured to be positioned between the first wall 124 and the first side 220 of the blade terminal 108. The first spring wall 170 includes multiple points of contact A with the blade terminal 108. The first spring wall 170 being spring biased against the blade terminal 108. The first spring wall 170 includes multiple points of contact B with the first wall 124. The first spring wall 170 being spring biased against the first wall 124. For example, as the first spring wall 170 is compressed between the blade terminal 108 and the terminal body 102, the spring wall 170 presses against the blade terminal 108 and the terminal body 102. Similarly, the second spring wall 190 includes multiple points of contact C with the second side 222 of the blade terminal 108, and multiple points of contact D with the second wall 126. The second spring wall 190 being spring biased against the second side 222 of the blade terminal 108, and being spring biased against the second wall 126. For example, as the second spring wall 190 is compressed between the blade terminal 108 and the terminal body 102, the spring wall 190 presses against the blade terminal 108 and the terminal body 102. The first side wall 156 wraps around the first wall 124 and includes one or more points of contact E with the outside of the first wall 124. The second side wall 158 wraps around the second wall 126 and includes one or more points of contact F with the outside of the second wall 126.

When the blade terminal 108 is loaded into the receiving space 128, the first and second spring walls 170, 190 are compressed between the blade terminal 108 and the terminal body 102. During assembly, when the blade terminal 108 is loaded into the receiving space 128 between the first and second spring walls 170, 190, the first and second spring walls 170, 190 may be at least partially deflected or flattened out by pressing the first spring wall 170 toward the first wall 124 and the second spring wall 190 toward the second wall 126. The wavy configuration of the first spring wall 170 forces the concave portions 174 to be biased against the first wall 124 and the convex portions 176 to be biased against the blade terminal 108. Similarly, the wavy configuration of the second spring wall 190 forces the concave portions 194 are biased against the second wall 126 and the convex portions 196 are biased against the blade terminal 108.

Figure 5:
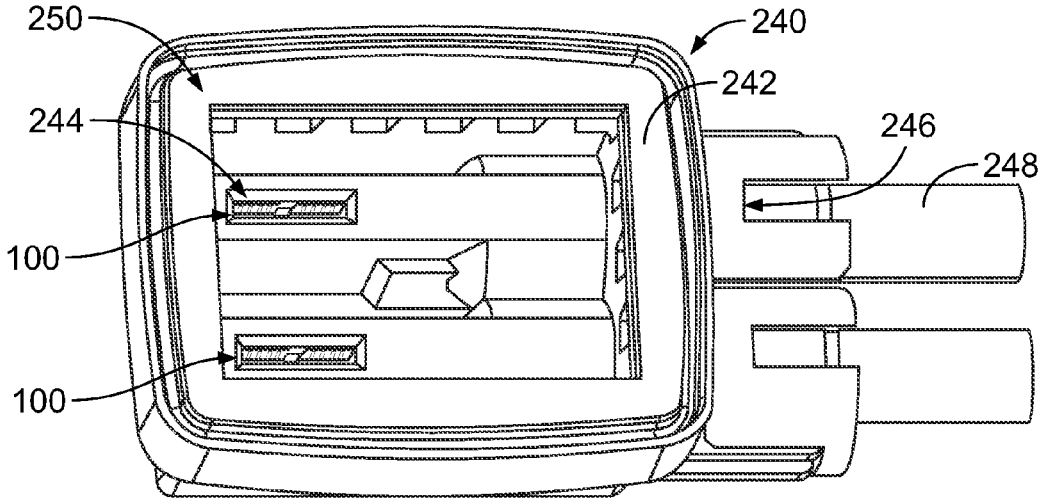
FIG. 5 is a front perspective view of a power connector including the receptacle terminal shown in FIG. 1.

FIG. 5 is a front perspective view of a power connector 240. The power connector 240 includes a housing 242 that is configured to hold one or more receptacle terminals 100. In the illustrated embodiment, the housing 242 holds two receptacle terminals 100. The housing 242 includes channels 244 that receive the receptacle terminals 100. The receptacle terminals 100 are exposed within the channels 244 such that the blade terminals 108 (shown in FIG. 1) may be loaded into the receptacle terminals 100. The housing 242 includes cable channels 246 that receive cables 248 and direct the cables to the corresponding receptacle terminals 100. The power connector 240 has a mating interface 250 configured to be mated with a mating power connector 260 (shown in FIG. 6).

Figure 6:
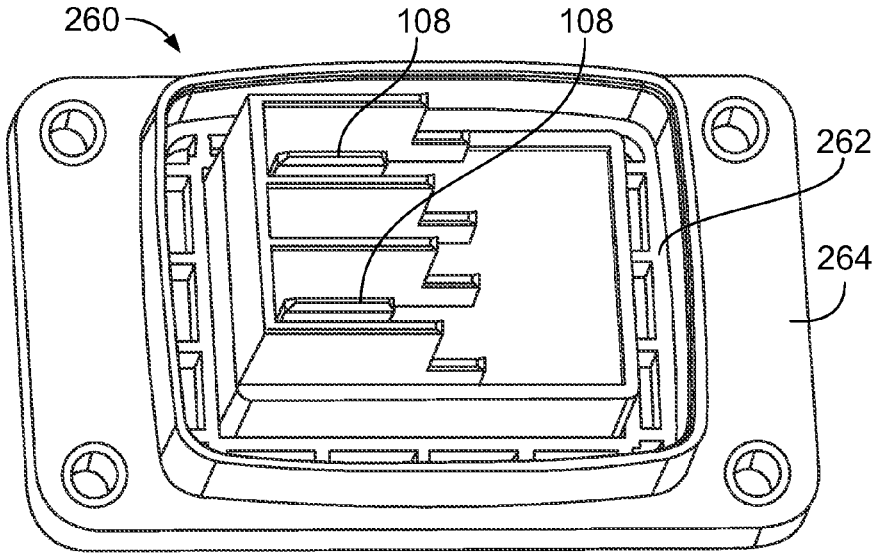
FIG. 6 is a front perspective view of the mating power connector that is configured to be mated the power connector shown in FIG. 5.

FIG. 6 is a front perspective view of the mating power connector 260 that is configured to be mated the power connector 240 (shown in FIG. 5). The mating power connector 260 includes a housing 262 holding two blade terminals 108 that are configured to be mated with the receptacle terminals 100 of the power connector 240. In an exemplary embodiment, the housing 262 includes a mounting flange 264 that is configured to be mounted to another structure, such as a chassis of a device that holds the mating power connector 260. The mating power connector 260 is held stationary such that the power connector 240 may be plugged into mating engagement with the mating power connector 260. When mated, the blade terminals 108 are received in the receptacle terminals 100 and a power connection is made therebetween.

In an exemplary embodiment, the mating power connector 260 and the power connector 240 may form part of a power system for a vehicle, such as an electrical vehicle. The power connector 240 and mating power connector 260 may be used in other applications in alternative embodiments, such as industrial applications.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle terminal comprising:

a terminal body comprising a cable end configured to be terminated to a cable and a mating end configured to be mated with a blade terminal, the terminal body comprising a receptacle at the mating end, the receptacle having a first wall and a second wall generally parallel to, and spaced apart from, the first wall, the receptacle having a receiving space between the first and second walls configured to receive the blade terminal; and a contact spring coupled to the terminal body, the contact spring having a first spring wall received in the receiving space and configured to be positioned between the first wall and the blade terminal, the first spring wall having an inner surface and an outer surface, the inner surface being spring biased against the first wall, the outer surface being configured to be spring biased against the blade terminal, the contact spring further comprising an end wall having opposite edges, first and second side walls extending from corresponding edges of the end wall, and a second spring wall, the first spring wall being connected to the first side wall by a connecting portion and the second spring wall being connected to the second side wall by a connecting portion, wherein the first side wall extends along an outside of the first wall of the terminal body and the second side wall extends along an outside of the second wall of the terminal body, and wherein the first spring wall extends along the first wall of the terminal body within the receiving space and the second spring wall extends along the second wall of the terminal body within the receiving space, the first and second spring walls being configured to engage opposites sides of the blade terminal when received in the receiving space.

2. The receptacle terminal of claim 1, wherein the end wall and the first and second side walls define a U-shaped structure, the first and second spring walls being positioned between the first and second side walls, the end wall extending between the first and second walls of the terminal body.

3. The receptacle terminal of claim 1, wherein the spring wall is non-planar having concave portions and convex portions, the concave portions engaging the first wall, the convex portions being configured to engage the blade terminal.

4. The receptacle terminal of claim 1, wherein the spring wall has a wavy configuration configured to make multiple points of contact with the first wall and multiple points of contacts with the blade terminal.

5. The receptacle terminal of claim 1, wherein the spring wall has slots formed therein defining spring fingers that are independently moveable.

6. The receptacle terminal of claim 1, wherein the contact spring is stamped and formed and configured to be removably coupled to the terminal body.

7. The receptacle terminal of claim 1, wherein the first wall has an opening therethrough, the contact spring having a tab received in the opening to locate the contact spring with respect to the terminal body.

8. A receptacle terminal comprising:

a terminal body comprising a cable end configured to be terminated to a cable and a mating end configured to be mated with a blade terminal, the terminal body comprising a receptacle at the mating end, the receptacle having a first wall and a second wall generally parallel to, and spaced apart from, the first wall, the receptacle having a receiving space between the first and second walls configured to receive the blade terminal; and a contact spring coupled to the terminal body, the contact spring having a spring wall received in the receiving space and configured to be positioned between the first wall and the blade terminal, the spring wall having an inner surface and an outer surface, the inner surface being spring biased against the first wall, the outer surface being configured to be spring biased against the blade terminal, wherein the contact spring defines a first contact spring, the receptacle terminal further comprising a second contact spring identical to the first contact spring, the first contact spring being coupled to a first end of the receptacle, the second contact spring being coupled to a second end of the receptacle.

9. The receptacle terminal of claim 8, wherein the contact spring defines a first contact spring, the spring wall defines a first spring wall, the contact spring further comprising an end wall having opposite edges, first and second side walls extending from corresponding edges of the end wall, and a second spring wall, the first spring wall extending from the first side wall and the second spring wall extending from the second side wall, wherein the first side wall extends along an outside of the first wall of the terminal body and the second side wall extends along an outside of the second wall of the terminal body, and wherein the first spring wall extends along the first wall of the terminal body within the receiving space and the second spring wall extends along the second wall of the terminal body within the receiving space, the first and second spring walls being configured to engage opposites sides of the blade terminal when received in the receiving space.

10. A receptacle terminal comprising:

a terminal body comprising a cable end configured to be terminated to a cable and a mating end configured to be mated with a blade terminal, the terminal body comprising a receptacle at the mating end, the receptacle having a first wall and a second wall generally parallel to, and spaced apart from, the first wall, the receptacle having a receiving space between the first and second walls configured to receive the blade terminal; and a contact spring comprising:

an end wall having opposite edges;

first and second side walls extending from corresponding edges of the end wall, the first side wall configured to extend along the first wall of the receptacle terminal, the second side wall configured to extend along the second wall of the receptacle terminal; and first and second spring walls extending from the first and second side walls, respectively, the first spring wall configured to extend along the first wall of the receptacle terminal within the receiving space, the second spring wall configured to extend along the second wall of the receptacle terminal within the receiving space, the first and second spring walls being configured to engage opposite sides of the blade terminal when received in the receiving space.

11. The contact spring of claim 10, wherein the end wall and the first and second side walls define a U-shaped structure, the first and second spring walls being positioned between the first and second side walls, the end wall holds the first and second side walls to limit deflection of the first and second walls of the terminal body away from one another when the blade terminal is loaded into the receptacle.

12. The contact spring of claim 10, wherein the first and second spring walls are non-planar having concave portions and convex portions, the convex portions being configured to engage the blade terminal.

13. The contact spring of claim 10, wherein the first and second spring walls have wavy configurations configured to make multiple points of contact with the blade terminal.

14. The contact spring of claim 10, wherein the first and second spring walls have slots formed therein defining spring fingers that are independently moveable.

15. The contact spring of claim 10, wherein the end wall, the first and second side walls and the first and second spring walls are stamped and formed and configured to be removably coupled to the receptacle terminal.

16. A power connector comprising:

a housing having a mating face; and a receptacle terminal held by the housing at the mating face, the receptacle terminal comprising:

a terminal body comprising a cable end configured to be terminated to a cable and a mating end configured to be mated with a blade terminal, the terminal body comprising a receptacle at the mating end, the receptacle having a first wall and a second wall generally parallel to, and spaced apart from, the first wall, the receptacle having a receiving space between the first and second walls configured to receive the blade terminal; and a contact spring coupled to the terminal body, the contact spring having a spring wall received in the receiving space and configured to be positioned between the first wall and the blade terminal, the spring wall having an inner surface and an outer surface, the inner surface being spring biased against the first wall, the outer surface being configured to be spring biased against the blade terminal, the spring wall having a plurality of spring fingers separated by slots, the spring fingers being independently movable relative to each other, the spring fingers having a wavy configuration such that each spring finger makes multiple points of contact with the first wall and each spring finger makes multiple points of contact with the blade terminal.

17. The power connector of claim 16, wherein the spring wall defines a first spring wall, the contact spring further comprising an end wall having opposite edges, first and second side walls extending from corresponding edges of the end wall, and a second spring wall, the first spring wall extending from the first side wall and the second spring wall extending from the second wall, wherein the first side wall extends along an outside of the first wall of the terminal body and the second side wall extends along an outside of the second wall of the terminal body, and wherein the first spring wall extends along the first wall of the terminal body within the receiving space and the second spring extends along the second wall of the terminal body within the receiving space, the first and second spring walls being configured to engage opposites sides of the blade terminal when received in the receiving space.

18. The power connector of claim 17, wherein the end wall and the first and second side walls define a U-shaped structure, the first and second spring walls being positioned between the first and second side walls, the end wall extending between the first and second walls of the terminal body.

19. The power connector of claim 16, wherein the spring wall is non-planar having concave portions and convex portions, the concave portions engaging the first wall, the convex portions being configured to engage the blade terminal.

20. The power connector of claim 16, wherein the contact spring defines a first contact spring, the receptacle terminal further comprising a second contact spring identical to the first contact spring, the first contact spring being coupled to a first end of the receptacle, the second contact spring being coupled to a second end of the receptacle.

* * * * *